US009664004B2

(12) United States Patent
Martinez et al.

(10) Patent No.: US 9,664,004 B2
(45) Date of Patent: May 30, 2017

(54) ELECTRIC HYDRAULIC INTERFACE FOR A MODULAR DOWNHOLE TOOL

(75) Inventors: Ruben Martinez, Houston, TX (US); Luis Parra, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 1153 days.

(21) Appl. No.: 13/518,899

(22) PCT Filed: Dec. 22, 2010

(86) PCT No.: PCT/US2010/061731

§ 371 (c)(1),
(2), (4) Date: Oct. 3, 2012

(87) PCT Pub. No.: WO2011/079173

PCT Pub. Date: Jun. 30, 2011

(65) Prior Publication Data

US 2013/0014939 A1 Jan. 17, 2013

Related U.S. Application Data

(60) Provisional application No. 61/290,093, filed on Dec. 24, 2009.

(51) Int. Cl.

| | |
|---|---|
| ***E21B 23/00*** | (2006.01) |
| ***E21B 17/02*** | (2006.01) |
| ***E21B 23/04*** | (2006.01) |

(52) U.S. Cl.

CPC ..... *E21B 23/00* (2013.01); *E21B 17/026* (2013.01); *E21B 17/028* (2013.01); *E21B 23/04* (2013.01)

(58) Field of Classification Search

CPC ..... E21B 23/04; E21B 47/00; E21B 41/00; E21B 17/028; E21B 17/02; E21B 23/00; E21B 17/026

(Continued)

(56) References Cited

U.S. PATENT DOCUMENTS 5,398,753 A 3/1995 Obrejanu et al.
5,947,198 A * 9/1999 McKee et al. ..... 166/66.4

(Continued)

FOREIGN PATENT DOCUMENTS

CN 1987045 A 6/2007
CN 101251007 A 8/2008

(Continued)

OTHER PUBLICATIONS

International Search Report & Written Opinion issued in PCT/US2010/061731 on Aug. 26, 2011; 10 pages.

(Continued)

*Primary Examiner* — Michael Wills, III
(74) *Attorney, Agent, or Firm* — Trevor G. Grove

(57) ABSTRACT

A modular donwhole tool system with a single electric hydraulic drive assembly. The assembly includes an electric hydraulic interface for coupling to any of a variety of different modular donwhole tools. Such tools may include a plug setting actuator, sleeve shifting actuator, valve effecting actuator and a variety of other radially or axially driven hydraulically powered actuators. Indeed, a variety of different actuators may be combined within the same system, tailored based on given downhole application needs. Thus, a viable off-the-shelf modular based on-site assemblage may be available to an operator for running off of a single electric hydraulic drive assembly.

5 Claims, 5 Drawing Sheets

(58) Field of Classification Search
USPC ..... 166/242.6, 378, 65.1, 250.01, 381
See application file for complete search history.

(56) References Cited

U.S. PATENT DOCUMENTS

| | | | | |
|---|---|---|---|---|
| 6,012,518 | A * | 1/2000 | Pringle | E21B 23/04 166/147 |
| 6,112,809 | A | 9/2000 | Angle | |
| 6,142,237 | A | 11/2000 | Christmas et al. | |
| 6,196,325 | B1 * | 3/2001 | Connell et al. | 166/377 |
| 6,213,202 | B1 * | 4/2001 | Read, Jr. | 166/55.1 |
| 6,582,145 | B1 * | 6/2003 | Malone et al. | 403/31 |
| 6,644,410 | B1 | 11/2003 | Lindsey-Curran et al. | |
| 6,715,554 | B1 | 4/2004 | Cunningham et al. | |
| 7,051,810 | B2 | 5/2006 | Clemens et al. | |
| 7,284,613 | B2 | 10/2007 | Billingham et al. | |
| 7,458,423 | B2 | 12/2008 | Vercaemer et al. | |
| 7,540,327 | B2 | 6/2009 | Billingham | |
| 7,559,361 | B2 | 7/2009 | Obrejanu | |
| 7,607,477 | B2 * | 10/2009 | Stoesz et al. | 166/242.6 |
| 7,661,477 | B2 | 2/2010 | Sheiretov et al. | |
| 7,886,834 | B2 | 2/2011 | Spencer et al. | |
| 8,028,752 | B2 | 10/2011 | Richards | |
| 8,286,716 | B2 | 10/2012 | Martinez et al. | |
| 2008/0078556 | A1 * | 4/2008 | Stoesz | E21B 17/023 166/378 |
| 2008/0190605 | A1 * | 8/2008 | Clapp | E21B 33/1246 166/250.17 |
| 2009/0025926 | A1 | 1/2009 | Briquet et al. | |
| 2009/0229817 | A1 * | 9/2009 | Partouche | 166/242.6 |
| 2010/0206582 | A1 * | 8/2010 | Meyyappan et al. | 166/378 |

FOREIGN PATENT DOCUMENTS

| | | | |
|---|---|---|---|
| CN | 101424170 | A | 5/2009 |
| CN | 101446197 | A | 6/2009 |
| CN | 101575971 | A | 11/2009 |
| WO | 2007123417 | A1 | 11/2007 |
| WO | 2008111844 | A1 | 9/2008 |

OTHER PUBLICATIONS

First Office Action for Chinese Application No. 201080059963.9 dated Jul. 2, 2014.
Third Office Action issued in CN application 201080059963.9 on Aug. 7, 2015, 9 pages.
Examination Report issued in related CA application 2785067 on Jan. 19, 2016, 5 pages.
International Preliminary Report on Patentability issued in the related PCT application PCT/US10/61731, dated Jun. 26, 2012 (8 pages).
Office action issued in the related CN application 201080059963.9, dated Mar. 13, 2015 (13 pages).
Office action issued in the related CN application 201080059963.9, dated Jan. 1, 2016 (14 pages).
Rejection Decision issued in the related CN application 201080059963.9, dated Aug. 2, 2016 (12 pages).
Office action issued in the related CA application 2785067, dated Nov. 9, 2016 (3 pages).
Office action issued in the related MX application MX/a/2012/007524, dated May 26, 2016 (7 pages).

* cited by examiner

ELECTRIC HYDRAULIC INTERFACE FOR A MODULAR DOWNHOLE TOOL

FIELD

Embodiments described relate to combined downhole actuator assemblies. Systems that incorporate multiple hydraulically driven assemblies for a single downhole deployment over a well delivery line are detailed. In particular, a line interface for accommodating combinations of modular plug setting, sleeve shifting, anchoring and other axially or radially actuating tool assemblies is described.

BACKGROUND

Exploring, drilling and completing hydrocarbon and other wells are generally complicated, time consuming, and ultimately very expensive endeavors. As a result, over the years, a significant amount of added emphasis has been placed on well monitoring and maintenance. Furthermore, perhaps even more emphasis has been directed at initial well architecture and design. All in all, careful attention to design, monitoring and maintenance may help maximize production and extend well life. Thus, a substantial return on the investment in the completed well may be better ensured.

In the case of well monitoring and logging, mostly minimally-invasive applications may be utilized which provide temperature, pressure and other production related information. By contrast, well design, completion and subsequent maintenance, may involve a host of more direct interventional applications. For example, sliding sleeves incorporated into a casing defining the well may be shifted open or closed to regulate production. Additionally, high pressure perforating and stimulating applications may be run at certain downhole well locations. Indeed, such applications may be preceded by the additional intervention of closing off and isolating the downhole locations with a bridge plug or mechanical packer capable of accommodating such high pressure applications. A host of other interventional applications may similarly be directed at downhole well regions.

In certain circumstances, attempts have been made to combine different application tools on a single delivery line. So, for example, a wireline cable may be used to deliver a logging tool coupled to a sleeve shifting tool such that both logging and sleeve shifting may be achieved with a single deployment into the well. Thus, several hours, if not days, are saved in avoiding the need for multiple deployments of tools into the well. However, it is worth noting that in such a circumstance, the interventional, sleeve shifting, tool is combined with a more passive tool which does not require its own large drive assembly.

In some circumstances, a more actively interventional tool, such as a plug setting tool or an anchoring tool, may be combined with the noted sleeve shifting tool. For example, anchoring and sleeve shifting actuation may serve to aid in advancement of the setting tool to a targeted location in the well for bridge plug deployment. In this manner, larger scale tractoring operations may be avoided in the circumstance of a vertical well that is prone to present certain downhole obstacles (e.g. hydrostatic sticking).

In this example scenario of combined anchoring, sleeve shifting, and plug setting tools incorporated into the same downhole system, each tool is equipped with its own independent drive assembly. Indeed, for these particular interventional actuator tools, each drive assembly would include a dedicated electronics module and a hydraulic power unit housing its own pump and motor.

Unfortunately, providing each tool with its own independent electric-hydraulic drive assembly on a single downhole system presents a whole new set of challenges and drawbacks, not the least of which is tripling drive assembly costs due to the utilization of three separate, independently driven, tools. For example, in the circumstance of a controlled pressure cased well, a riser, generally about 60 feet high, may be positioned at the well head to help regulate and maintain pressure. This limits the overall length of the downhole system that may be attached to the wireline cable (e.g. no more than about 60 feet in the example scenario). Thus, in a likely circumstance where each drive assembly and associated tool exceed about 25 combined feet, the overall system, 75 feet in length, would be unavailable for deployment in the well.

Other concerns beyond size and expense of such a combined system of different tools and assemblies also persist. For example, the inclusion of multiple electronics modules means that multiple electronic boards are utilized. Thus, the odds of electronic board failure on any given run in the well with the system are inherently driven up. Ultimately, on the whole, combined active interventional tools on the same downhole system are generally avoided due to practical concerns over size, expense, and reliability.

SUMMARY

An interface is provided for coupling to one of a variety of different modular hydraulically driven downhole tools. The interface includes an electrical connection configured for coupling to another electrical connection of the one tool. A hydraulic connection is also accommodated at the interface for coupling to another hydraulic connection of the one tool.

DETAILED DESCRIPTION

Embodiments herein are described with reference to drive assemblies for delivery and deployment of modular plug setting tools and plugs. These embodiments focus primarily on the axially and hydraulically driven setting of plugs for well isolation in advance of high pressure perforating or fracturing applications. However, other types of hydraulically driven modular tools may be delivered and deployed by such a drive assembly, perhaps in conjunction with such a noted plug setting tool. For example, a modular sleeve shifting, anchoring or other modular tool that is radially or axially driven may be delivered and utilized. Regardless, embodiments of the drive assemblies are configured with an electric hydraulic interface for coupling to any of a variety of different interchangeable modular hydraulically driven tools.

Figure 1:
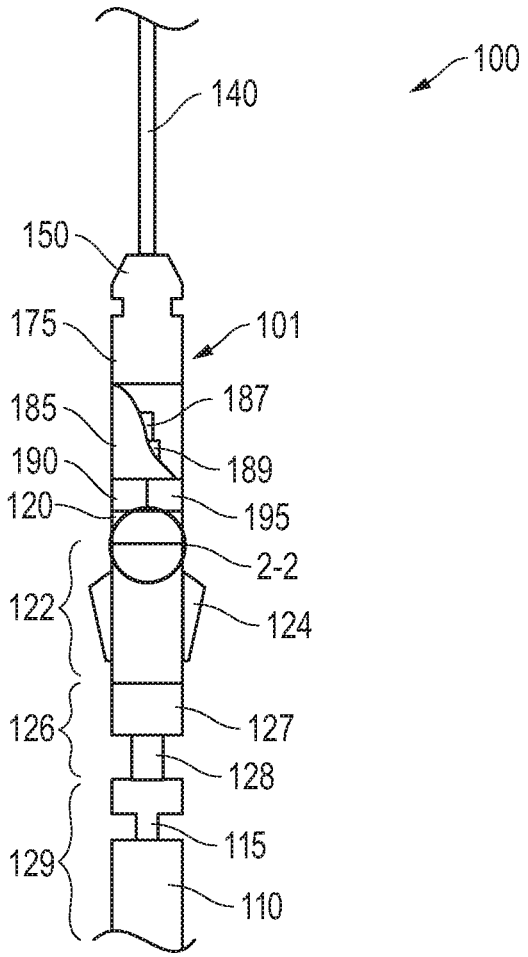
FIG. 1 is a front view of an embodiment of a downhole system employing a single electric hydraulic drive assembly for multiple modular tools.

Referring now to FIG. 1, a front view of an embodiment of a downhole system 100 is shown which utilizes a single electric hydraulic drive assembly 101 in conjunction with multiple modular tools 122, 126, 129. That is to say, to the extent that any of the tools 122, 126, 129 requires or is in need of external electrical or hydraulic capacity, such may be provided through the single drive assembly 101. Thus, the need for dedicated multiple electric hydraulic drive assemblies for each of the tools 122, 126, 129 is avoided. As such, the overall size of the system may be reduced in conjunction with associated costs. Further, operational reliability may be improved through the reduction in the number of component parts that are subject to failure during operations, most noticeably in this regard, a reduction in electrical parts.

The drive assembly 101 is equipped with an electric hydraulic interface 120 that serves as a common socket or coupling platform. Thus, as detailed further below, any number of tools 122, 126, 129 outfitted with a coupling end configured for reception by the interface 120 may be plugged into it. In the particular embodiment shown, an anchoring actuator 122 is shown coupled to the interface 120 of the assembly 101. However, an axial actuator 126, a plug setting actuator 129 or other downhole tool may be plugged directly into the interface 120. Indeed, as detailed further herein, a variety of modular tool combinations may be plugged into the interface 120, as well as to one another, in constructing the system 100.

Figure 2A:
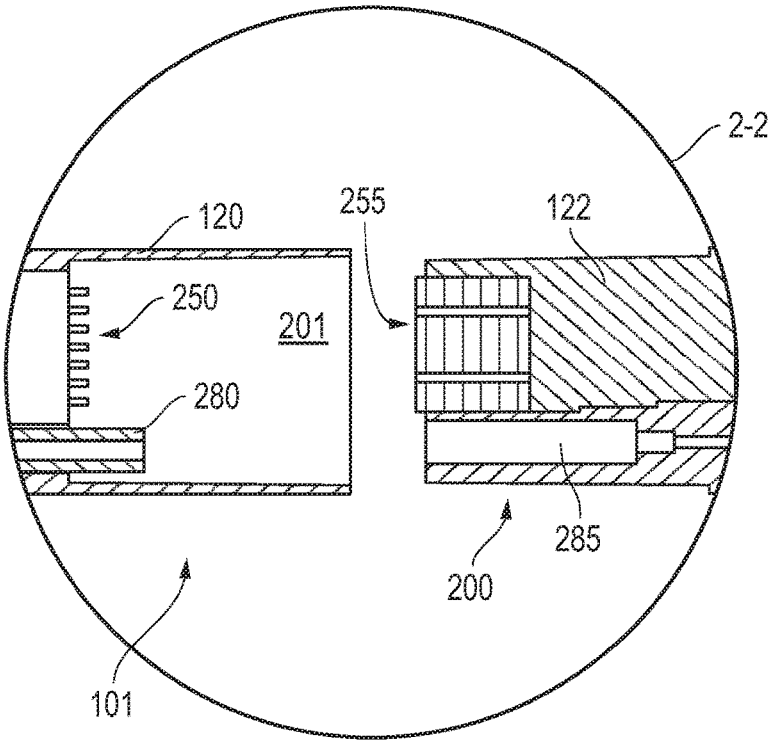
FIG. 2A is an enlarged side view of interfacing between the drive assembly of FIG. 1 and a modular tool of the system.
Figure 2B:
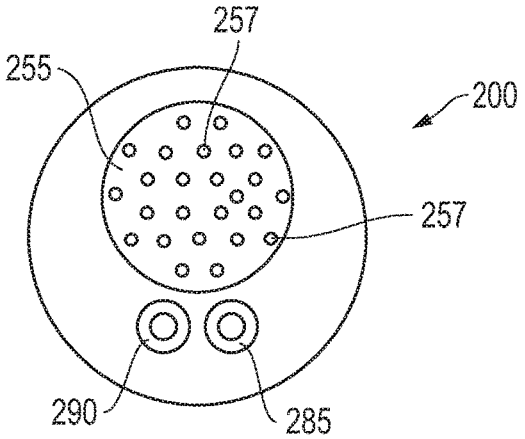
FIG. 2B is a front view of the coupling end of the modular tool of FIG. 2A for receiving the interface of the drive assembly.
Figure 3:
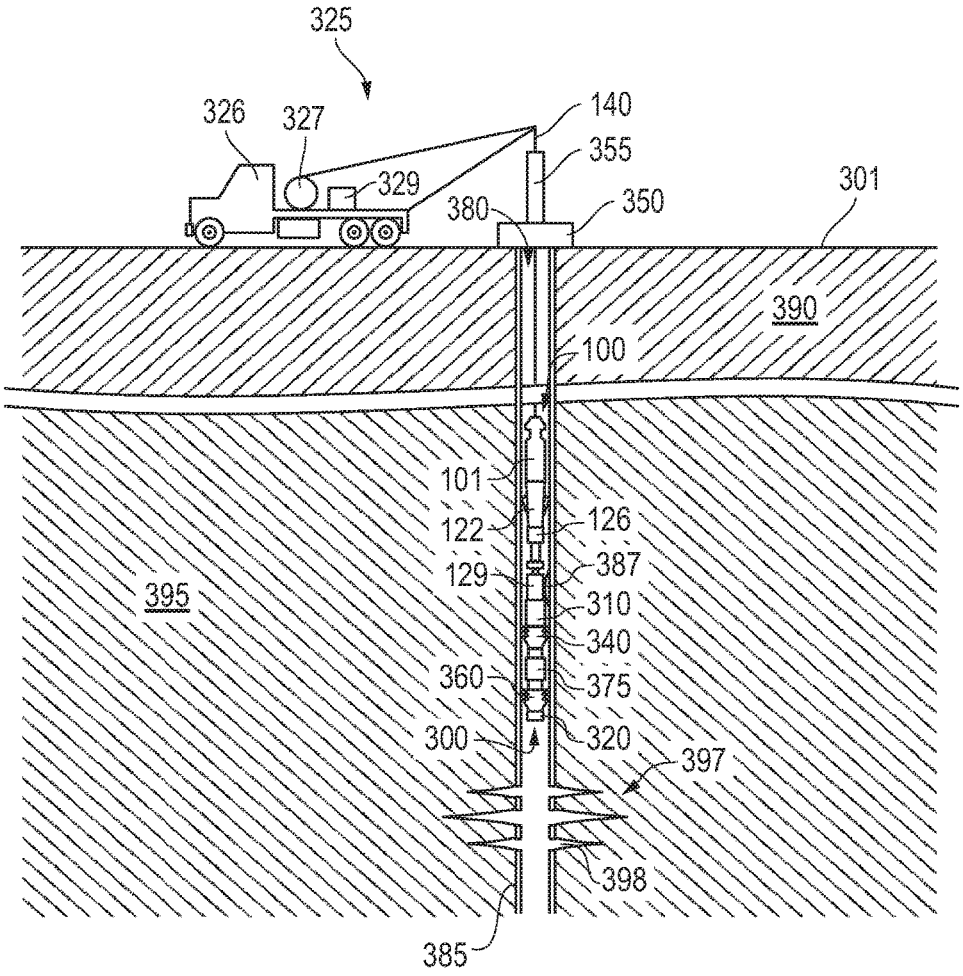
FIG. 3 is an overview of an oilfield with a well thereat accommodating the downhole system of FIG. 1 with multiple modular tools for bridge plug setting.

Continuing with reference to FIG. 1, the embodiment of the system 100 depicted is directed at setting a well isolation mechanism, such as a mechanical packer or a bridge plug 300, in the well 380 of FIG. 3. Thus, one of the tools of the system is the noted plug setting actuator 129. The actuator 129 includes a housing sleeve 110 which may be hydraulically driven for directing the setting of the noted plug 300 in the well 380 of FIG. 3. To support such hydraulic drive, the system 100 is equipped with hydraulics running from the drive assembly 101 and commonly from one modular tool to the next until reaching the plug setting actuator 129. Support for such hydraulics, as well as electrical lines, between the assembly 101 and the last of the tools is detailed further below with respect to FIGS. 2A and 2B. Regardless, with hydraulics available all the way down to the plug setting actuator 129, the sleeve 110 may be shifted in a downhole direction for compression and setting of the plug 300 of FIG. 3 as also detailed further herein.

Continuing with reference to FIG. 1, the system 100 is shown with additional tools 122, 126 to aid in plug delivery and deployment. These tools 122, 126 are disposed between the plug setting actuator 129 and the drive assembly 101 and are detailed further below. Additionally, the system 100 itself is secured to a wireline cable 140 at its head 150. Thus, the hydraulics for driving the noted housing sleeve 110 may be electrically powered over the cable 140 from surface. Furthermore, real-time telemetry over electronics of the cable 140, or through associated fiber optics thereof, may also be available. As a result, diagnostics, feedback and responsive control over setting of the plug 300 of FIG. 3 with the setting actuator 129 may be reasonably available. For example, in the embodiment shown, a pressure sensor 190 and control valve 195 may be incorporated into the system 100 to allow for intelligent control over the setting application.

In the embodiment shown, the drive assembly 101 is equipped with an electronics housing 175 accommodating a processor for directing downhole applications, such as the noted plug setting, through an adjacent power housing 185. This housing 185 accommodates a downhole motor 187 and pump 189 for driving of the housing sleeve 110 as noted above. The pump 189 may be an axial piston pump, such as the commercially available AKP model from Bieri™ Hydraulics of Switzerland. However, a variety of other axial piston pump models, suitably sized for downhole use may be utilized. Regardless, the pump 189 is configured to supply between about 7,500 to 10,000 PSI or more for adequate setting of the plug 300, as detailed below. Once more, anchoring, axial driving, sleeve shifting and other system functions may be adequately driven by the same pump 189 and drive assembly 101 as described further below.

Continuing with reference to FIG. 1, hydraulics for the shifting of the housing sleeve 110 are accommodated over an extension 115 of the actuator 129. Indeed, as noted above, common hydraulics are provided through the various modular tools 122, 126 and back through the interface 120. Further, the plug setting actuator 129 is configured to hydraulically provide enough setting force to attain setting of a radially expandable, mechanical well isolation mechanism such as the plug 300 of FIG. 3.

The availability of a sensor 190, electronics and real-time downhole telemetry may allow for monitoring a host of variables during, or in advance of or after, the setting application. For example, pump speed and fluid pressure operational testing may take place in advance of operations so as to help set operation parameters. Such variables may then be monitored during operations to ensure consistency and effectiveness thereof. Indeed, where substantial variances are detected, changes to the plug setting application may be made in real-time as conveyed over the wireline cable 140. Such advance testing may also be utilized to establish maximum pressure and other system tolerances which may be monitored during operations to allow for corrective action where appropriate. Furthermore, in addition to overall hydraulics or the drive assembly 101, pretesting and real-time operational monitoring may also be directed at any of the individual tools 122, 126, 129 of the system 100.

As indicated above, the embodiment of FIG. 1 includes anchor 122 and axial 126 actuators disposed between the setting actuator 129 and the interface 120. More specifically, the anchor actuator 122 is plugged into the interface 120 in the manner described above. Further, in the same manner, the axial actuator 126 is plugged into the anchor actuator 122, as is the setting actuator 129 plugged into the axial actuator 126. Indeed, a modular chain of such tools 122, 126, 129 is strung together so as to tailor the system 100 for use in a particular downhole operations. So, for example, the embodiment of FIG. 1 may be particularly adept at anchoring, axially driving past a downhole obstruction, and setting a bridge plug as detailed in FIG. 3. Of course, these and other such modular tools may be added, rearranged, or limited to no more than one in constructing the system 100 for a given downhole environment and application.

With additional focus on the intervening tools 122, 126 supporting the described setting application, hydraulically driven anchoring and axial drive may be of significant benefit to the deployment aspect of operations. For example, in deployment of the setting actuator 129 and bridge plug 300 of FIG. 3 to a targeted downhole location, certain obstructions, hydrostatic sticking and other obstacles may be presented. Thus, as detailed further below, arms 124 of a modular anchor actuator 122 may anchor the entire system 100 in place adjacent the obstacle. With a head 127 mounted to the anchor actuator 122, a piston 128 of the axial actuator 126 may be employed to advance the setting actuator 129 past the obstacle to the target location. With hydraulic power of about 7,500-10,000 PSI available from the drive assembly 101, as described above, more than about 35,000 lbs. of force may be available in this manner through the axial actuator 126. Indeed, due to the described modularity, electronics and hydraulics in support of all of these actuator tools 122, 126, 129 may be derived from the same drive assembly 101.

Continuing now with reference to FIG. 2A, an enlarged side view of interfacing between the drive assembly 101 of FIG. 1 and a modular tool 122 is shown. More specifically, the anchor actuator 122 is shown oriented for coupling to the interface 120 of the drive assembly 101. For sake of illustration, the actuator 122 is depicted slightly unplugged from the interface 120 as opposed to the completed coupling between these devices as depicted in FIG. 1. Thus, the male and female components of each device may be readily identified as detailed below. Additionally, the interface 120 of the assembly 101 is representative of other interfaces that may be found at one end of any of the modular tools 122, 126, 129 to allow their linking together (e.g. see interfaces 120, 520, 522 of FIG. 5A). By the same token, a coupling end 200 of the anchor actuator 122, for plugging into the interface 120, is representative of coupling structure that may be provided to each modular tool 122, 126, 129 (e.g. at an end opposite the interfacing structure).

The interface 120 of the drive assembly 101 is largely of a female configuration in the embodiment shown. For example, it includes a large cavity 201 for reception of the coupling end 200 of the anchor actuator 122. By the same token, the interface 120 also includes male components in the form of a hydraulic extension 280 and a pin array 250. Of course, in alternate embodiments, the male or female nature of the interface 120 and its components may be all male, female, or any suitable combination for coupling to the end 200 of a correspondingly configured actuator 122.

Continuing with reference to FIG. 2A, the coupling end 200 of the actuator 122 is of a largely male configuration as indicated above. However, it is also equipped with female components in the form of a hydraulic receptacle 285 and pin reception housing 255. These components are configured for secure reception of the hydraulic extension 280 and the pin array 250, respectively. Thus, with the extension 280 and array 250 appropriately secured and the coupling end 200 retained in the cavity 201 a completed coupling of interface 120 and actuator 122 may be achieved.

Referring now to FIG. 2B, a front view of the coupling end 200 of the modular actuator 122 is depicted. From this angle, individual electronic pin receivers 257 of the reception housing 255 are visible. Additionally, a second hydraulic receptacle 290 is shown for pairing with another hydraulic extension of the interface 120 of FIG. 2A. In one embodiment, the receptacles 285, 290 may be ports that take the form of spring loaded check valves that are opened by the coupling of the extensions (e.g. 280) thereto. Regardless, as alluded to above, a platform for multiple hydraulic lines may be commonly provided through the drive assembly 101 and modular tools, such as the depicted anchor actuator 122.

In the case of electronic passage, common electronic lines are also provided through the assembly 101 and modular tools via the linked couplings detailed above. So, for example, any of the modular tools may be equipped with a processor or control module that is responsive to commands from surface as detailed below. In fact, solenoid valves, sensors and other electronic features may be provided to any modular tool to allow for data recording, surface monitoring or application alterations as needed.

Referring now to FIG. 3, an overview of an oilfield 301 is depicted with a well 380 which accommodates the downhole system 100 of FIG. 1. The system 100 includes the single drive assembly 101, multiple modular tools 122, 126, 129, and a bridge plug 300 for setting and isolating at a location in the well 380. The well 380 traverses various formation layers 390, 395 and may include certain obstructions 387, intended or otherwise as noted above. The well 380 is also defined by a casing 385 that is configured for sealing and anchored engagement with the plug 300 upon running of a setting application as described further below. In the embodiment shown, the plug 300 is equipped with upper 340 and lower 360 slips to achieve anchored engagement with the casing 385 upon the setting. Similarly, a generally elastomeric, sealing element 375 is disposed between the slips 340, 360 to provide sealing of the plug 300 relative the casing 385 by way of the setting application.

As detailed above, a variety of modular tools or actuators 122, 126, 129 share a common drive assembly 101 along with its electric and hydraulic capacity. In the embodiment shown, the particular actuators 122, 126, 129 selected for the system 100 are tailored at driving the plug 300 to the targeted location and running a setting application thereat. More specifically, anchor 122 and axial 126 actuators are provided to allow for selective inchworm-like advancement of the system 100 past the depicted obstruction 387. So, for example, rather than requiring deployment of a downhole tractor and substantial surface equipment in support thereof, a modular off-the-shelf type of system 100 utilizing linked tools 122, 126, 129 may be configured on-site. Once more, the added tools 122, 126 which support driving of the setting actuator 129 into position, may simply share the drive assembly 101 already available for the setting application.

Continuing with reference to FIG. 3, the assembly of the setting actuator 129 and plug 300 includes a platform 320 at its downhole end. This platform 320 is coupled internally to the extension 115 of FIG. 1. Thus, with added reference to FIG. 1, the plug 300 is compressed between this platform 320 and the housing sleeve 110 as this sleeve 110 is forced against the plug 300. In this way, the setting application ultimately radially expands plug components into place once the plug 300 is positioned in a targeted location.

In the embodiment shown, the targeted location for placement and setting of the plug 300 is immediately uphole of a production region 397 with defined perforations 398. So, for example, the plug 300 may be utilized to isolate the region 397 for subsequent high pressure perforating or stimulating applications in other regions of the well 380.

Continuing with reference to FIG. 3, the wireline delivery of the assembly means that even though obstructions 387 may be present and a relatively high powered setting application is to be undertaken, such may be handled with relatively small mobile surface equipment 325. Indeed, the entire assembly traverses a riser 355 and the well head 350 and is tethered to a spool 327 of a wireline truck 326 without any other substantial deployment equipment requirements.

In the embodiment shown, a control unit 329 for directing the deployment and setting is also shown. The control unit 329 may ultimately be electrically coupled to the electronics of the drive assembly 101 so as to monitor and intelligently control the delivery and setting of the plug 300. That is to say, the unit 329 may initiate actuation of any of the modular tools 122, 126, 129 and also modify the application in real-time, depending on monitored pressure and other electronically obtained application data.

Figure 4A:
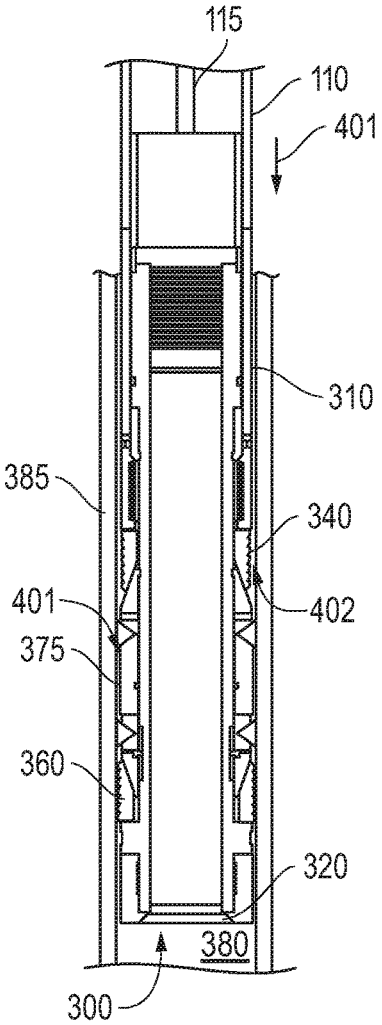
FIG. 4A is an enlarged side view of the bridge plug and modular setting tool of FIG. 3 positioned at a targeted isolation location in the well.
Figure 4B:
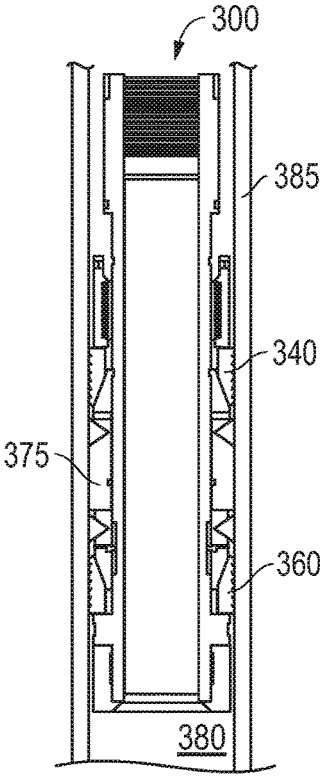
FIG. 4B is an enlarged side view of the bridge plug of FIG. 4A upon setting thereof at the targeted isolation location.

Referring now to FIGS. 4A and 4B, enlarged side views of the bridge plug 300 and lower portion of the setting actuator 129 of FIG. 3 are depicted positioned at the noted targeted location in the well 380 for isolation. More specifically, FIG. 4A depicts the initiation of the setting application as the plug 300 is compressed between the housing sleeve 110 and the platform 320. FIG. 4A depicts the plug 300 following setting with the housing sleeve 110 removed and the slips 340, 360 and seal 375 in a complete radially expanded state. Indeed, interfacing spaces 401, 402 remain between plug components and the casing 385 in FIG. 4A. However, compression into the radially expanded state as depicted in FIG. 4B reveals an elimination of such spaces 401, 402 in conjunction with anchoring by the slips 340, 360 and isolating engagement by the seal 375 at the casing 385.

Of course, the modular system 100 of FIG. 1 may be arranged or tailored in a variety of different ways depending on the particular downhole challenges presented in a given operation. For example, as opposed to setting a bridge plug 300 as depicted in FIG. 3, a sleeve shifting application in the well 380 may be at hand. Thus, for sake of illustration, FIGS. 5A and 5B reveal an alternate embodiment of a downhole system 100 employing an alternate modular tool in the form of a sleeve shifting actuator 500.

Recall that the drive assembly 101 of the system 100 includes an interface 120 that may be standardized for reception of any number of modular tools 122, 126, 500 (or 129 of FIG. 1). In an embodiment, the interface 120 may employ a couple of hydraulic ports or extensions 280 and about 30 electrical connections in a pin array 250 (see FIG. 2A). Indeed, as a matter of supporting off-the-shelf modular construction, each modular tool 122, 126 that is to couplingly receive another may also include such a standardized interface 520, 522.

Figure 5A:
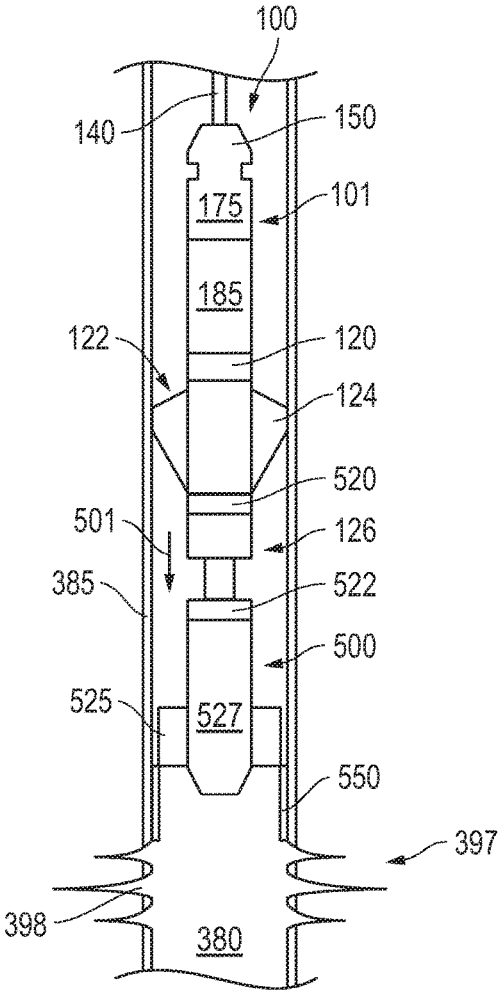
FIG. 5A is a view of an alternate embodiment of a downhole system with an alternate modular tool for sleeve shifting in the well.
Figure 5B:
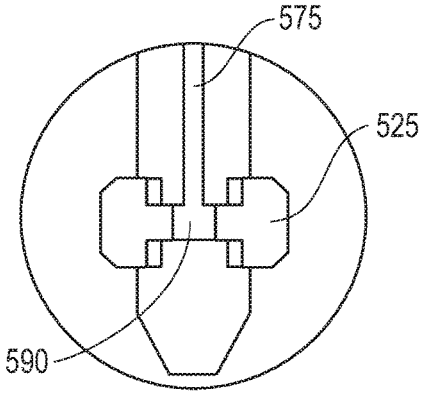
FIG. 5B is an enlarged cross-sectional view of the modular sleeve shifting tool of FIG. 5A.

Continuing with reference to FIGS. 5A and 5B, the axial actuator 126 is utilized to attain axial movement of the sleeve shifting actuator 500 in a downhole direction 501. However, in this case, such powered movement is not utilized to traverse an obstruction 387 as in the embodiment of FIG. 3. Rather, in the embodiment of FIG. 5A, such movement may be utilized to slide a sleeve 550 over the production region 397 to close off production from individual perforations 398 thereof.

With added reference to FIG. 5B, engagement arms 525 may be driven into an expanded state from a central body 527. This may be achieved hydraulically through pressurization of a central chamber 590 at the terminal end of a hydraulic line 575. This line 575 is ultimately coupled to the drive assembly 101 through common hydraulics running back through each of the modular tools 122, 126 as detailed above. Indeed, in this same manner, radial expansion of the anchor arms 124 of the anchor actuator 122 may be achieved. Indeed, any number or combination of such radial or axial modular actuator tools may be employed in the overall system 100 and equipped with electric and hydraulic capacity for operation as detailed hereinabove.

The above described embodiments avoid utilization of multiple independent electric-hydraulic drive assemblies where multiple downhole interventional tools are to be employed. This is achieved in a manner that limits overall length of the system while also keeping drive assembly expenses at a minimum. Once more, the number of electronic boards utilized for the downhole system are kept at a minimum. Thus, the likelihood of board failure on any given run of the system in the well is reduced.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. For example, in addition to traversing obstructions and shifting sliding sleeves, embodiments of tailored modular electric hydraulic systems may be utilized for opening and closing isolation valves. Furthermore, the foregoing description should not be read as pertaining only to the precise structures described and shown in the accompanying drawings, but rather should be read as consistent with and as support for the following claims, which are to have their fullest and fairest scope.

We claim:

1. A modular downhole system comprising:

an electric hydraulic drive assembly;

a modular downhole tool ,wherein the modular downhole tool is an anchor actuator, and wherein the anchor actuator is coupled to the electric hydraulic drive assembly with an interface;

an axial actuator connected with a lower end of the anchor actuator, wherein the axial actuator is electrically and hydraulically coupled to the anchor actuator; and a plug setting actuator connected with a lower end of the axial actuator, wherein the plug setting actuator is electrically and hydraulically coupled to the axial actuator, wherein anchoring the anchor actuator in a well and axially moving the axial actuator affects a position of the plug setting actuator.

2. The system of claim 1 further comprising a wireline cable secured thereto for deployment into a well.

3. The system of claim 1 further comprising a well isolation mechanism coupled to said plug setting actuator.

4. The system of claim 3 wherein said well isolation mechanism is one of a mechanical packer and a bridge plug.

5. A method of performing an application in a well with a modular system, the method comprising:

electrically and hydraulically coupling a modular tool of the system to an interface of a drive assembly of the system, wherein the modular tool is an anchor actuator;

electrically and hydraulically coupling an axial actuator to the anchor actuator;

electrically and hydraulically coupling a plug setting actuator to the anchor actuator;

disposing the system into the well over a wireline cable;

setting an anchor using the anchor actuator;

moving the axial actuator to move the plug setting actuator past an obstacle and to a desired location;

operating the plug setting actuator when the desired location is reached;

obtaining application data during said setting of the anchor actuator, moving of the axial actuator, and operating the plug setting actuator; and altering said setting of the anchor actuator, moving of the axial actuator, and operating the plug setting actuator based on the obtained date.

* * * * *